US006695518B2

(12) United States Patent
Ruble et al.

(10) Patent No.: US 6,695,518 B2
(45) Date of Patent: Feb. 24, 2004

(54) OVERLAY BINDER INCLUDING PERFORATED EASY-RELEASE LABEL LEADER

(76) Inventors: Paul E. Ruble, P.O. Box 1139, Fillmore, CA (US) 93015; Jacqueline T. Ruble, P.O. Box 1139, Fillmore, CA (US) 93015

( * ) Notice: Subject to any disclaimer, the term of this patent is extended or adjusted under 35 U.S.C. 154(b) by 0 days.

(21) Appl. No.: 10/047,217

(22) Filed: Jan. 14, 2002

(65) Prior Publication Data

US 2003/0133743 A1 Jul. 17, 2003

(51) Int. Cl.[7] ..... B42F 13/00

(52) U.S. Cl. ..... 402/73; 281/21.1; 402/3; 402/80 R; 402/502; D19/26

(58) Field of Search ..... 281/21.1, 15.1, 281/36, 3; 402/73, 80 R, 502; D19/26, 27, 33

(56) References Cited

U.S. PATENT DOCUMENTS 1,677,277 A * 7/1928 Federbush et al. ..... 40/653
2,207,930 A * 7/1940 Miller ..... 294/99.2
4,681,472 A 7/1987 Ruble ..... 402/3
4,848,799 A * 7/1989 Turetsky ..... 156/240
4,892,333 A * 1/1990 Krulich ..... 223/50
4,998,840 A 3/1991 Ruble ..... 402/3
5,330,279 A 7/1994 Ruble ..... 402/3
5,462,783 A * 10/1995 Esselmann ..... 283/36
6,267,412 B1 * 7/2001 Henderson ..... 281/15.1

* cited by examiner

*Primary Examiner*—Monica S. Carter
(74) *Attorney, Agent, or Firm*—Koppel, Jacobs, Patrick & Heybl

(57) ABSTRACT

An improved system for labeling the spine of a binder is disclosed. The system includes an improved flexible label leader to load labels into a binder slot. The leader includes a first end portion having an adhesive section for adhering a binder label thereto. It also includes a second end portion for pulling the label adhered to the first end portion into a binder slot and a middle portion between the first and second end portions that resides in said binder slot. The adhesive section of the first end portion in detachable from the remainder of the leader.

13 Claims, 3 Drawing Sheets

OVERLAY BINDER INCLUDING PERFORATED EASY-RELEASE LABEL LEADER

BACKGROUND OF THE INVENTION

1. Field of the Invention

The present invention relates to an improved label leader and method for inserting a label into a slot on the spine of a loose-leaf binder.

2. Description of the Related Art

The present invention constitutes an improvement to the "SELF-LOADING BINDER" disclosed in U.S. Pat. No. 4,681,472 ('472 patent) issued Jul. 21, 1987, and to the "OVERLAY BINDER INCLUDING EASY-RELEASE LABEL LEADER" disclosed in U.S. Pat. No. 5,330,279 ('279 patent) issued on Jul. 19, 2001. The invention is also compatible with the "METHOD AND TOOL FOR RETROFITTING AN ELONGATED LABEL LEADER INTO THE SLOT OF AN OVERLAY BINDER", disclosed in U.S. Pat. No. 4,998,840, issued Mar. 12, 1991. All the above were invented by Paul E. Ruble, one of the inventors for the present invention.

Loose-leaf binders and other bound works may be conveniently provided with transparent overlays on their spines that are sealed along the longitudinal edges of the spine. An elongated pocket or slot is defined between the cover and spine into which a label may be inserted to identify the contents of the bound work. This arrangement is highly preferable to conventional labeling methods such as affixing an adhesive label to the outer surface of the spine, since a label attached in the present manner is protected from wear and tear by the durable overlay.

Without the improvements disclosed in the above-referenced patents, a label is difficult to insert into a binder slot due to the length of the slot, and the fact that the overlay fits tightly over the spine. Attempts to insert a label into the slot will generally result in folds being created in the center portion of the label by the force used to push the label into the slot. Additional damage may also be done to the binder spine and/or overlay if a pen, paper clip, or similar sharp object is used to force the label into the slot.

The arrangement disclosed in the '472 patent is illustrated in FIGS. 1 and 2. A bound work, here shown as being a loose-leaf binder 10, includes an end cover or spine 12, and front and rear covers 14 and 16 which are attached to the spine 12 along longitudinal edges 18 and 20 thereof respectively. A transparent overlay 22 is sealed to the spine 12 along or adjacent to the longitudinal edges 18 and 20 to define a pocket or slot 24 between itself and the surface of the spine 12.

In order to enable a label made of flexible paper or the like to be inserted into the slot 24 for identification of the contents of the binder 10, a thin, flexible leader 26 extends through the slot 24 and protrudes therefrom at its opposite ends. As viewed in FIG. 1, the upper end of the leader 26 has a releasable adhesive portion 28 formed thereon which faces away from the binder 10. The leader 26 is long enough so that the ends thereof may be folded back over the spine 20, with the adhesive portion 28 on the upper end being releasably adhered to the facing surface of the lower end of the leader 26 as illustrated in FIG. 2. The ends of the leader 26 are thereby secured together in a convenient and compact manner over the spine 26 of the binder 10 for storage, shipping and sales.

FIGS. 3*a* to 3*d* are simplified diagrams illustrating how the leader 26 is used to insert a label into the slot 24 in accordance with the '472 patent. These figures, as well as similar figures which will be referenced below, are not drawn to scale, but are compressed along the axis of the spine 12 to facilitate description of the invention.

As viewed in FIG. 3*a*, the lower end portion of a flexible label 30 is pressed down onto the adhesive portion 28 of the leader 26 and releasably adhered thereto. As illustrated in FIG. 3*b*, the lower end of the leader 26 is then gripped and pulled downwardly, thereby pulling the label 30 downwardly into the slot 24. FIG. 3*b* shows the label 30 as being pulled approximately half way into the slot 24, whereas in FIG. 3*c* the label 30 has been pulled all the way into the slot 24.

The leader 26 is released from the label 30 by applying finger pressure to the overlay 22 at a position such as designated by a cross 32 to immobilize the label 30, and then pulling down on the leader 26 with increased force until the adhesive portion 28 releases or detaches from the label 30 as shown in FIG. 3*d*.

The directions included with overlay binders, which are sold to the public including label leaders 26 as disclosed in my prior patents, advise that the step of FIG. 3*d* should be performed by popping the leader 26 free of the label 30 using a gentle side to side motion. No problems are encountered if the directions are followed. However, users who do not receive or read the directions or who are careless and/or impatient tend to jerk on the leader 26 rather than detach it gently as advised.

The adhesive portion 28 must be strong enough to grip the label 30 as it is being pulled through the slot 24, and is detached from the label 30 in the step of FIG. 3*d* by shear force. If the leader 26 is jerked rather than being gently popped free, part of the label 30 can shear and be torn off by the adhesive portion 28 and detach with the leader 26. It is also possible for part of the leader 26 to be torn off and remain adhered to the label 30 by the adhesive portion 28. The appearance of the label 30 is spoiled in both cases.

Also, the label 30 needs to be adhered to the leader 26 so that both are in longitudinal alignment. This allows the label 30 to be more easily pulled into the slot by the leader 26. If they are not aligned properly, the edges of the label 26 can hit one of the slot's edges preventing the label 26 from being pulled into the slot or damaging the label.

The leader in the '279 patent overcomes some of the problems described above by providing an improved label leader arrangement 40 as shown in FIGS. 4*a* to 4*f*. The leader 42 can be quickly and easily detached from a label after the leader has been used for inserting the label into the binder slot 41, even if the leader is jerked roughly by a careless user. The elongated, flexible label leader 42 is designed to extend through the slot 41 and protrude therefrom at its opposite ends. A first adhesive portion 44 is formed on one end portion of the leader 42. A label 46 may be inserted into the slot 41 by releasably adhering an end of the label 46 to the leader's first adhesive portion 44, and pulling on the leader's other end 48, thereby pulling the attached label 46 into the slot 41.

The leader 42 is improved for easy release or detachment from the label 46 by further including a loop 50 portion which is folded back over and adhered to the surface of the end portion of the leader 42 opposite to the surface on which the first adhesive portion 44 is formed. A second adhesive portion 51 is included to hold the surfaces together to form the loop 50. When the label is pulled completely into the slot 41, part of the leader's loop portion 50 protrudes from the end of the slot 41.

The leader is detached from the label by pulling on the protruding part 52 of the loop portion 50. This causes the first adhesive portion 44 of the leader to be peeled away from the label 46. The peeling action, as opposed to the shearing action as in the arrangement of the '472 patent, enables the adhesive portion to easily and smoothly detach from the label without tearing the leader or label, even if the end of the loop portion is jerked roughly rather than being pulled gently as directed.

One disadvantage of this leader is that it is more complicated and more expensive. It is also more bulky than the leader disclosed in the '472 patent. As a result, the binder requires more storage space and the leader has a greater tendency to be damaged during storage. The adhesive part of the leader occasionally tears away part of the label when the leader and label are separated, damaging the appearance of the label. Also, the label and leader can be adhered out of longitudinal alignment making it difficult to pull the label into the slot.

SUMMARY OF THE INVENTION

The present invention is an improved apparatus for labeling the spine of bound works. One embodiment of the apparatus includes an improved flexible label leader to load labels into a binder slot. The leader has a first end portion having an adhesive section for adhering a binder label thereto. It also has a second end portion for pulling the label adhered to the first end portion into a binder slot, and a middle portion between the first and second end portions that resides in said binder slot. The adhesive section of the first end portion in detachable from the remainder of the leader.

A bound work is also disclosed which comprises a cover and a transparent overlay which is sealed along its longitudinal edges to an outer surface of the cover to define a slot between the cover and the overlay which has top and bottom transverse ends which are at least partially open. A flexible label leader is included that has a central portion which extends through the slot. It also has a first end portion which protrudes from the top transverse end of the slot with an adhesive section for adhering a binder label thereto. A second end portion, which protrudes from said bottom end of the slot. The label leader includes a means for detaching the adhesive section from said first, second and central portions with the preferred means being a transverse perforation.

In operation, the adhesive section of the flexible label leader is adhered to the back surface of a label and the leader is then used to pull the label into the binder slot. The leader is then removed from the label by tearing the perforation, leaving the adhesive section adhered to the label in the slot. This eliminates the possibility that the label will be damaged when the leader is removed from it. If the bottom edge of the label is aligned with the transverse perforation, the adhesive section that remains is not visible. Also, if the label's bottom edge is aligned with the perforation, the label and leader are longitudinally aligned to provide for label loading without interfering with the edge of the slot.

By having a perforation the new label leader is more adaptable for use in automatic label loading equipment. The new leaders fold flatter for storage compared to the loop leader embodiment and are less likely to be damaged in storage. Leader removal is more easily understood by end user without having to reference the use instructions.

These and other further features and advantages of the invention will be apparent to those skilled in the art from the following detailed description, taken together with the accompanying drawings, in which:

DETAILED DESCRIPTION OF THE INVENTION

Figure 1:
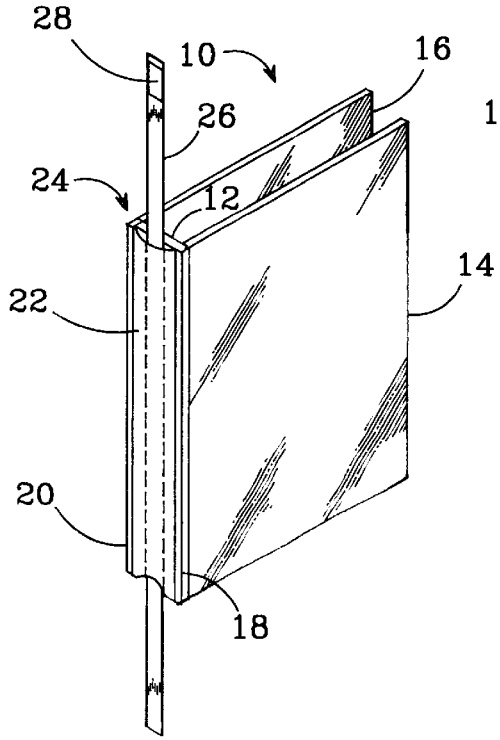
FIG.1 (Prior Art)
FIG. 1 is a perspective view of a loose-leaf binder provided with a label leader in accordance with the above referenced '472 patent.
Figure 2:
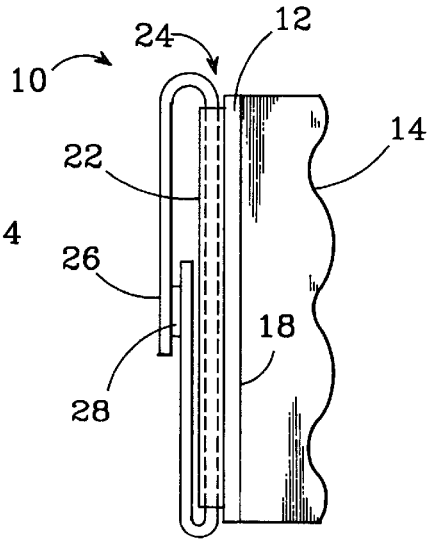
FIG.2 (Prior Art)
FIG. 2 is a side elevation view of the binder and label leader assembly shown in FIG. 1.
Figure 3A:
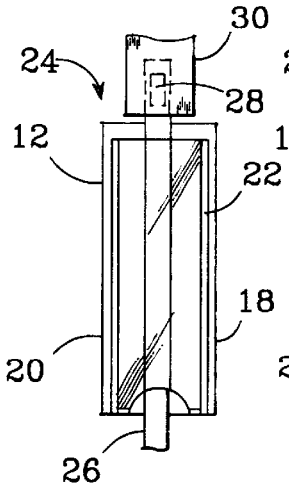
FIG.3a (Prior Art)
FIGS. 3*a* to 3*d* are simplified front elevation views illustrating the use of the binder and label leader assembly of FIGS. 1 and 2.
Figure 3B:
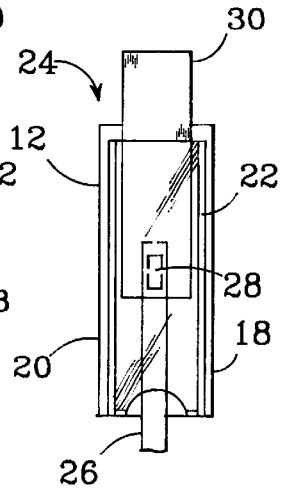
FIG.3b (Prior Art)
Figure 3C:
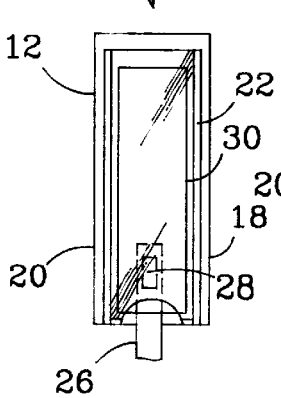
FIG.3c (Prior Art)
Figure 3D:
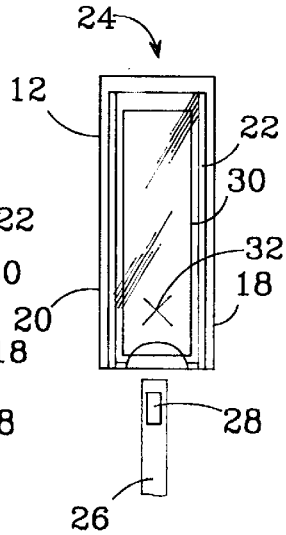
FIG.3d (Prior Art)
Figure 4A:
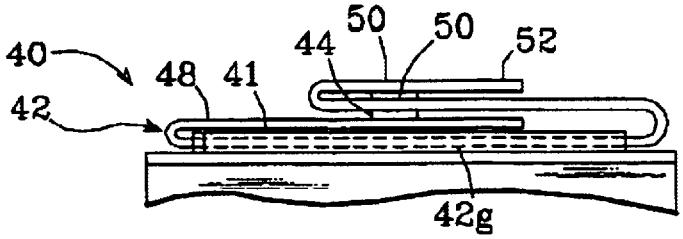
FIG.4a (Prior Art)
FIGS. 4*a* to 4*f* are side elevation views of the binder and label leader assembly in accordance with the above referenced '279 patent, illustrating its use.
Figure 4B:
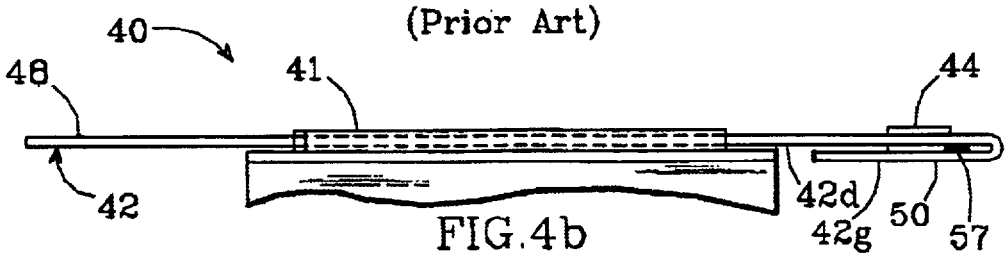
FIG.4b (Prior Art)
Figure 4C:
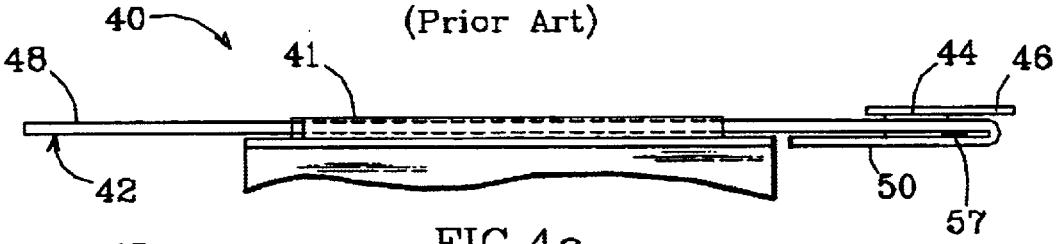
FIG.4c (Prior Art)
Figure 4D:
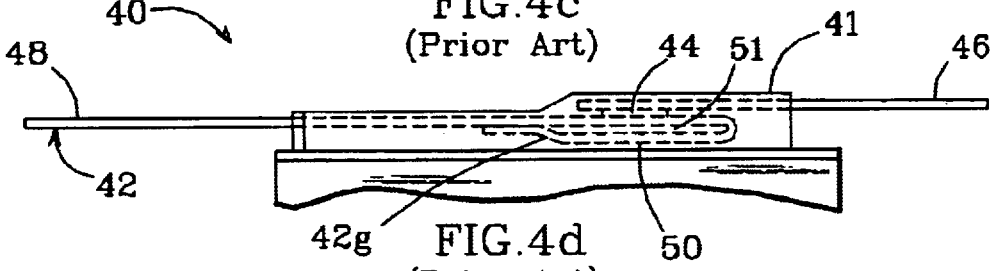
FIG.4d (Prior Art)
Figure 4E:
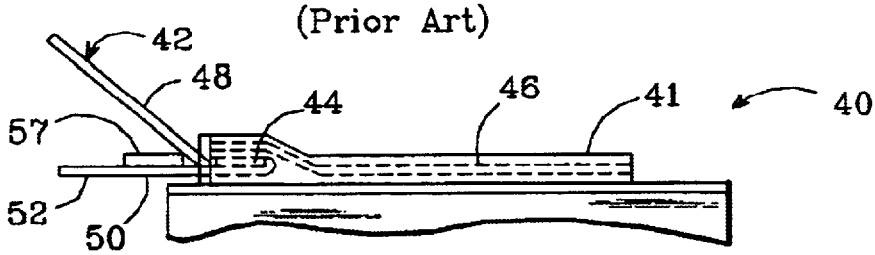
FIG.4e (Prior Art)
Figure 4F:
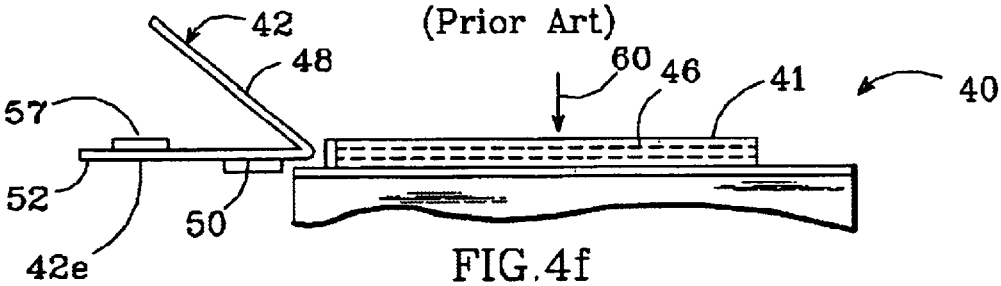
FIG.4f (Prior Art)
Figure 5:
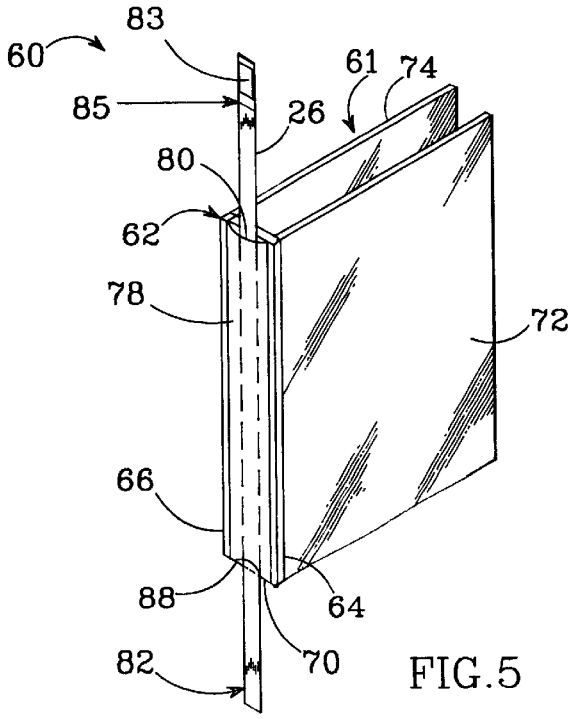
FIG. 5 is a perspective view of a loose-leaf binder provided with a label leader in accordance with the present invention.
Figure 6:
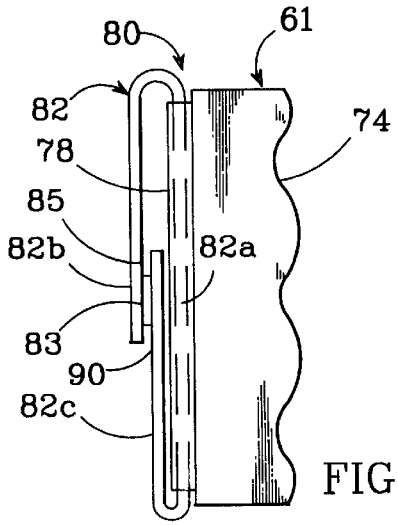
FIG. 6 is a side elevation view of the binder and label leader assembly shown in FIG. 5.

FIGS. 5 and 6 show one embodiment of a binder leader system 60 in accordance with the present invention. The leader system 60 can be used with many different types of binders with the binder 61 being a standard loose-leaf binder. The binder 61 is comprised of a spine 62 with a pair of parallel longitudinal edges 64 and 66 and a pair of parallel transverse edges 68 and 70. Front and rear covers 72 and 74, respectively, are attached to the spine along each longitudinal edge with hinges located at the spines longitudinal edges 64 and 66, between the covers 72 and 74 and the spine 62.

A transparent or semitransparent cover 78 is located on the spine 62 and sealed to the spine along the longitudinal edges 64 and 66, forming a slot 80 between the spine 62 and the cover 78. The slot 80 is sized to accept flexible labels made of paper or the like, which are generally undersized as compared to the length and width of the slot 80. A leader 82 is located in the slot 80 and extends beyond the non-sealed transverse edges 68 and 70 of the spine 62. For one-inch (2.5 cm) binders, a label is typically about 2.1 cm wide and 28 cm long, although other sizes will also work. The label leader 82 may be as wide as or wider than the label, but is preferably narrower than the label, typically 8 mm wide and 63.5 cm long, and is made of a strong, yet flexible plastic, paper or other suitable material.

A portion of the cover's bottom transverse edge can also be sealed, leaving an unsealed segment 88 near the middle of the spine's lower edge 70. The unsealed segment 88 can be in the form of a cut away which is slightly wider than the leader 82. This provides a stop for the lower end of the label, while still enabling the leader 82 to protrude from both ends of the slot 80.

In binder 61, the overlay cover 78 extends beyond the spine 62 to cover the front and back covers 72 and 74, and sealed to the bottom and side edges of the covers. The top edges of the front and back covers 72 and 74 can be left unsealed, allowing additional labels to be inserted into the area between the overlay cover 78 and the covers 72 and 74, if desired.

The leader 82 includes a central portion 82*a* which extends through the slot 80, a first end portion 82*b* which protrudes from the top of the slot 80 and a second end portion 82*c* which protrudes from the bottom of the slot 80. The first end portion 82*b* has an adhesive portion 83 near the end of the leader 82. The adhesive is preferably an adhesive tab that may or may not be covered with a dust cover (not shown). The adhesive portion 83 can also consist of any releasable adhesive material that is applied to the end leader portion 82*b*.

In a preferred embodiment, the adhesive portion 83 allows the leader 82 to be attached to a label 89 to pull the label into the slot 80. The end portion 82*b* is also arranged to allow the adhesive section to be separated from the remainder of the leader 82. The separation can be facilitated by having a transverse perforation, score or other means 85 of separating the two sections, with a preferred means being a transverse perforation.

The leader's second end 82*c* can also be waxed on its surface 90. The leader 82 is stored in the slot 80 by bringing its opposite ends 82*b* and 82*c* together along the outside of the overlay cover 78. The adhesive portion 83 is then attached to the waxed surface 90, so that the leader extends entirely around the overlay cover as illustrated in FIG. 6.

In an alternate embodiment, a detachable cover is positioned over the adhesive portion to protect the adhesive portion from contacting foreign material that may effect its ability to adhere.

The label leader system 60 is assembled with a binder 61 by placing the leader 82 longitudinally along the binder's spine 62 before the overlay cover 78 is installed. The overlay cover 78 is then installed over the spine 62 and the front and rear covers 72 and 74 and is sealed along the longitudinal edges 64 and 66 of the spine 62 and the side and bottom edges of each cover 72 and 74. A non-sealed segment 88 remains along the bottom transverse edge 70 of the spine 62 through which the leader 82 can be pulled.

When using the new leader system, the leader's first end 82*b* is removed from the second end 82*c* by pulling the adhesive section 83 away from the waxed surface 90. The leader 82 now extends from both ends of the slot 80 as shown in FIG. 5. A label 89 (or other identifying means) is attached to the adhesive portion 83 at the leaders first end 82*b*, as shown in FIG. 7*a*. When the leader 82 is pulled down through the slot 80, the label 89 is pulled through the slot's top edge and into the slot 80 as shown in FIGS. 7*b* and 7*c*. The leader 82 and the label 8 are pulled through the slot 80 until the label 86 is positioned at a desired location.

The manner in which the present leader 82 detaches from the label 89 is different from that of the prior art arrangements. In the arrangement disclosed in the '472 patent the leader is detached from the label by shear force. In the arrangement disclosed in the '279 patent, the leader is detached from the label by pulling on the looped portion and causing the leader to progressively peel away from the label.

Figure 7E:
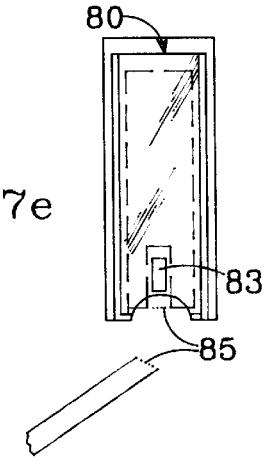
FIGS. 7*a* to 7*e* are simplified front elevation views illustrating the use of the binder and label leader assembly of FIGS. 5 and 6.
Figure 7A:
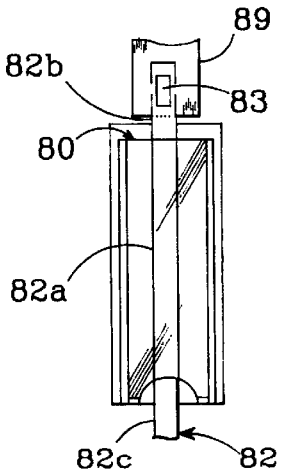
Figure 7B:
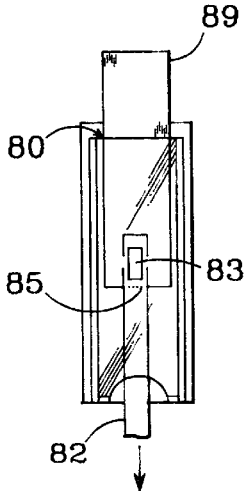
Figure 7C:
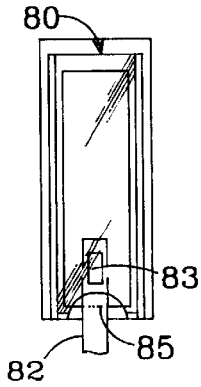
Figure 7D:
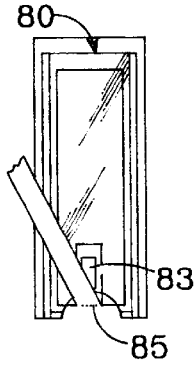

In steps of FIGS. 7*d* and 7*e* the leader 82 is detached from its adhesive portion 83 by tearing the leader 82 along its transverse perforation 85. This can be accomplished by simply pulling the leader 82 down and to the left or right so that the perforation tears to the left or right, respectively. The perforation 85 can be made to tear more easily by first folding the leader 82 at the perforation 85 before pulling the leader. The folding weakens the perforation 85, which allows it to tear more easily. The leader 82 can also be removed by folding it at the perforation and pulling up and to the left or right as shown in FIG. 7*d*. This forces the perforation 85 against the bottom edge of the slot 80 so that the edge cuts into the perforation 85, causing it to tear more easily.

The transverse perforation 85 also provides a marking to assist in the longitudinal alignment of the label 89 and leader 82. When adhering the label 89 to the leader 82, the bottom edge of the label 89 can be aligned with the perforation 85, with the leader 82 at or near the center of the label's bottom edge. The perforation 85 and label's bottom edge are transverse to the longitudinal axis of the leader 82 and label 89, and as a result aligning the perforation with the bottom edge longitudinally aligns the label 89 and leader 82. The label 89 can then be pulled into the slot 80 without interfering with one of the slot's side edges.

An apparatus and system for labeling the spine of a bound work has been shown and described which is highly effective. As numerous modifications and alternate embodiments of the invention will occur to those skilled in the art, it is intended that the invention be limited only in terms of the appended claims.

I claim:

1. A flexible label leader to load labels into a binder slot, comprising:

a first end portion having an adhesive section for adhering a binder label thereto;

a second end portion for pulling said label adhered to said first end portion into a binder slot; and a middle portion between said first and second end portions, said middle portion residing in said binder slot, said adhesive section of the first end portion being capable of adhering to a label such that said label can be pulled into said binder slot by said label leader, said first end also detachable from said middle portion along a transverse score or perforation such that said first end remains adhered to said label and substantially hidden behind said label, said label leader also including a means for longitudinally aligning said label leader and said binder label so that said label is capable of being pulled into said slot without the edges of said label hitting the longitudinal edges of said slot, said alignment means comprising said transverse score or perforation and a transverse edge of said label that is aligned with said score or perforation.

2. The label leader of claim 1, wherein said transverse perforation is adjacent to said adhesive section to allow said adhesive section to be detachable from said portions.

3. The label leader of claim 1, wherein said score is adjacent to said adhesive section to allow said adhesive section to be detachable from said portions.

4. The label leader of claim 1, wherein said label is aligned with said perforation when said label is adhered to said adhesive section, said adhesive section being detachable from the other said portions along said perforation.

5. The label leader of claim 1, wherein said label is aligned with said score when said label is adhered to said adhesive section, said adhesive section being detachable from the other said portions along said score.

6. A bound work comprising:

a cover;

a transparent overlay which is sealed along its longitudinal edges to an outer surface of the cover to define a slot between the cover and the overlay which has top and bottom transverse ends which are at least partially open; and a flexible label leader, including:

a central portion which extends through the slot;

a first end portion which protrudes from said top transverse end of the slot and has an adhesive section for adhering a binder label thereto;

a second end portion which protrudes from said bottom end of the slot; and a means for detaching said adhesive section from said first, second and central portions, said label leader also including a means for longitudinally aligning said label leader and said binder label so that said label is capable of being pulled into said slot without the edges of said label hitting the longitudinal edges of said slot, said alignment means comprising aligning said detaching means with a transverse edge of said label.

7. The bound work of claim 6, in which said first and second end portions of the leader are sufficiently long that they can be releasably adhered together by the adhesive means when they are folded back over the overlay.

8. The bound work of claim 7, wherein said means for detaching includes a transverse perforation adjacent to said adhesive section.

9. The bound work of claim 7, wherein said means for detaching includes a transverse score adjacent to said adhesive section.

10. The bound work of claim 7, where said flexible leader is made of plastic.

11. The bound work of claim 7, where said flexible leader is made of paper.

12. The bound work of claim 6, wherein said alignment means comprises a transverse perforation and a transverse edge of said label that is aligned with said perforation when said label is adhered to said adhesive section, said perforation also being said means for detaching said adhesive section.

13. The bound work of claim 6, wherein said alignment means comprises a transverse score and a transverse edge of said label that is aligned with said score when said label is adhered to said adhesive section, said perforation also being said means for detaching said adhesive section.

* * * * *